United States Patent [19]

Long

[11] Patent Number: 4,849,261

[45] **Date of Patent: * Jul. 18, 1989**

[54] PATTERN FORMING SATURATOR AND METHOD

[75] Inventor: Eliot R. Long, Arlington Heights, Ill.

[73] Assignee: Miply Equipment, Inc., South Bend, Ind.

[ * ] Notice: The portion of the term of this patent subsequent to Oct. 27, 2004 has been disclaimed.

[21] Appl. No.: 73,516

[22] Filed: Jul. 15, 1987

Related U.S. Application Data

[63] Continuation-in-part of Ser. No. 883,550, Jul. 9, 1986, Pat. No. 4,702,943.

[51] Int. Cl.[4] ..... B05D 5/00; B05D 1/18; B05C 3/132; B05C 3/20

[52] U.S. Cl. ..... 427/282; 68/158; 118/406; 118/419; 118/429; 427/434.2; 427/434.5

[58] Field of Search ..... 427/282, 434.2, 434.5; 118/406, 419, 429; 68/158

[56] References Cited

U.S. PATENT DOCUMENTS

| | | | |
|---|---|---|---|
| 1,546,834 | 7/1925 | Hanington | 101/129 |
| 2,056,274 | 10/1936 | Holdsworth | 264/167 |
| 2,711,032 | 6/1955 | Penley | 34/122 |
| 2,904,448 | 9/1959 | Sorg | 427/208.2 |
| 3,088,859 | 5/1963 | Smith | 156/26 |
| 3,436,245 | 4/1969 | Grundman | 428/89 |
| 3,772,054 | 11/1973 | Anselrode | 427/282 |
| 4,280,343 | 7/1981 | Fleissner | 68/158 |
| 4,588,616 | 5/1986 | Menser | 427/430.1 |
| 4,702,943 | 10/1987 | Long | 118/406 X |

*Primary Examiner*—Evan Lawrence
*Attorney, Agent, or Firm*—Willian Brinks Olds Hofer Gilson & Lione Ltd.

[57] ABSTRACT

A saturator of the type comprising a chamber situated between a chamber defining element and a mandrel, in which a web is moved between the chamber defining element and the mandrel to impregnate the web with a saturant contained in the chamber includes at least one saturant delivery port which extends across substantially the entire width of saturation zone which extends only partially across the web if the chamber defines a plurality of saturating zones. In this way, uniformity of saturation across the chamber is improved.

6 Claims, 5 Drawing Sheets

PATTERN FORMING SATURATOR AND METHOD

CROSS REFERENCE TO RELATED APPLICATION

This application is a contination-in-part of copending U.S. patent application Ser. No. 06/883,550, filed July 9, 1986, now U.S. Pat. No. 4,702,943.

BACKGROUND OF THE INVENTION

The present invention relates to saturators for impregnating a substrate with a saturant.

Saturators have been used for some time to impregnate substrates such as webs of paper with varying amounts of saturants. By properly selecting the amount and type of saturant to provide the desired characteristics to the substrate, saturators can be used to enhance the physical characteristics, and therefore the value, of the substrate.

For example, one valuable saturant is sodium silicate. When high levels of sodium silicate are added to a paper web, the paper can be made fire resistant and can be given much improved structural strength. However, such highly impregnated paper can be difficult to fold or crease in conventional paper processing machines. It therefore would be advantageous to impregnate a paper web with sodium silicate only at selected portions of the web. For example, if a paper web were to be used to form a box in which stacking strength were an important consideration, it would often be advantageous to apply sodium silicate only to the sidewalls of the box, and not to the top and bottom panels, which must be folded in use.

As another example, containers such as beer cases are subjected to unusual wear patterns. The tops and bottoms of the cans within the case act as cookie cutters during transportation and can severely damage either the printing on or the actual structure of the top and bottom panels of the case. If sodium silicate were applied to the top and bottom panels, this cookie cutter effect could be resisted effectively. In this example, however, there is no need to apply sodium silicate to the sidewalls, and it would save the cost of materials if the saturant could be placed on only the top and bottom panels and not the sidewalls of the case.

In spite of the important advantages that selective saturation would provide in the examples described above, the applicant is unaware of any saturator that performs this function. The saturator described in Menser U.S. Pat. No. 4,588,616 is an extremely effective device which can be used to saturate substrates with a range of saturants at both relatively low and extremely high add-on weights. Similarly, U.S. Pat. No. 2,721,144 describes another type of saturator used in the past. However, neither of these saturators is provided with means for selectively impregnating only portions of the web with the saturant.

In the past, stencils have been used with a variety of surface applicators for liquids of various types. However, such stencils have not, to the knowledge of the applicant, been used with saturators. Instead, stencils have typically been used with applicators which apply liquid to the surface of a web without substantial impregnation. Examples of such applicators are spray devices (Smith U.S. Pat. No. 3,088,859); extruders (Sorg U.S. Pat. No. 2,904,448); roller applicators (Holdsworth U.S. Pat. No. 2,056,274); and spreaders (Hannington U.S. Pat. No. 1,546,834). Such applicators differ significantly from saturators in that they apply a liquid to the surface of the substrate without specific pressure to force the applied liquid into the interstices of the substrate and therefore do not provide deep impregnation as does a saturator.

SUMMARY OF THE INVENTION

The present invention is directed to an improved saturator and method for saturating a web.

This invention relates to improvements to a saturator of the type which comprises means for defining a saturation zone for containing a pressurized saturant therein, and means for moving a web through the saturation zone along a transportation axis to bring a first side of the web into contact with the pressurized saturant to cause the saturant to impregnate the web. According to this invention saturant is introduced into the saturation zone via one or more saturant ports which extend across substantially the full width of the saturation zone tranverse to the translation axis. In this way more uniform saturation of the web can be obtained, because cross-web non-uniformities caused by uneven distribution and velocity of the saturant are substantially eliminated.

In the embodiments described below, a saturator of the type comprising means for defining a chamber for containing a pressurized saturant therein, and means for moving a web through the chamber to bring a first side of the web into contact with the pressurized saturant to cause the saturant to impregnate the web, is provided with a stencils having at least one impermeable region shaped to cover less than the entire web. Means are provided for passing the stencil through the chamber at the same speed as the web with the stencil juxtaposed against the first side of the web, such that portions of the web aligned with the at least one impermeable region are not impregnated with the saturant, while other, exposed portions of the web are impregnated with the saturant.

In these embodiments, a saturant is selectively applied only to a patterned portion of a web with a saturador of the type comprising means for defining a chamber for containing a pressurized saturant therein, and means for moving the web through the chamber to bring a first side of the web into contact with the pressurized saturant to cause the saturant to impregnate the web. This method comprises the steps of (1) providing a stencil having at least one impermeable region shaped to cover less than the entire web, and (2) passing the stencil through the chamber at the same speed as the web with the stencil juxtaposed against the first side of the web, such that the portions of the web aligned with the at least one impermeable region are not impregnated with the saturant, and other, exposed portions of the web are impregnated with the saturant.

As described in detail below, this method provides important advantages in that it allows only selected patterned portions of a web to be impregnated with the saturant. By applying the saturant only where it is needed on the web, the cost of saturant is reduced, and the end product can actually be improved. For example, impregnation of the web can be avoided in regions where the web will be creased or folded, such that the saturant does not interfere with such subsequent processing operations. As another example, saturant can be kept out of contact with patterned portions of the web which will subsequently be printed in the event a saturant is used with detracts from the clarity or color trueness of the printing operation.

The invention itself, together with further objects and attendant advantages, will best be understood by reference to the following detailed description, taken in conjunction with the accompaying drawings.

Figure 1:
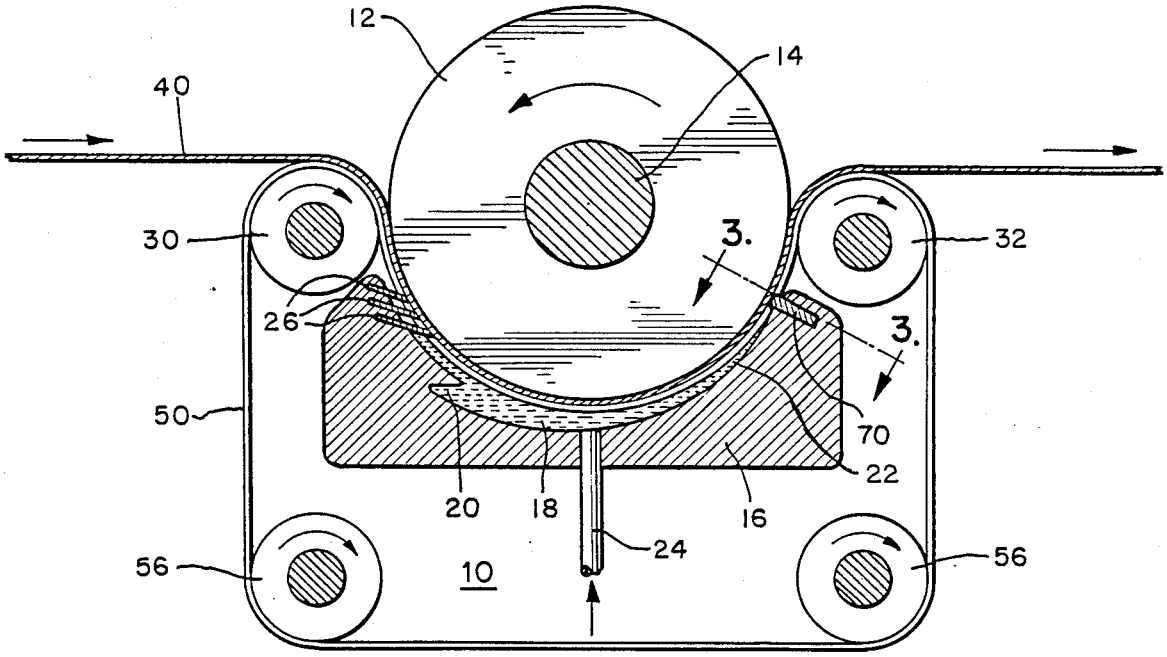
FIG. 1 is a cross-sectional view through a pattern-forming saturator.

FIGS. *2a*, *2b* , and *2c* are partial views of alternative stencils suitable for use in the saturator of FIG. 1.

Figure 3:
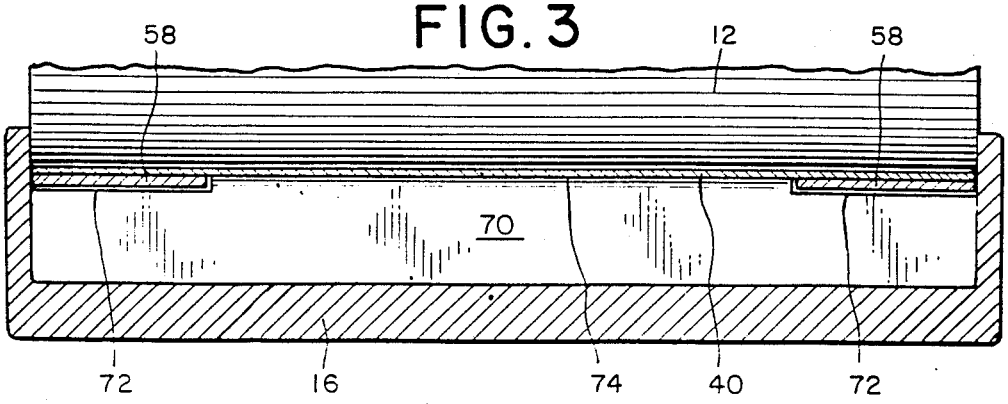

FIG. 3 is a sectional view taken along line 3—3 of FIG. 1.

Figure 4:
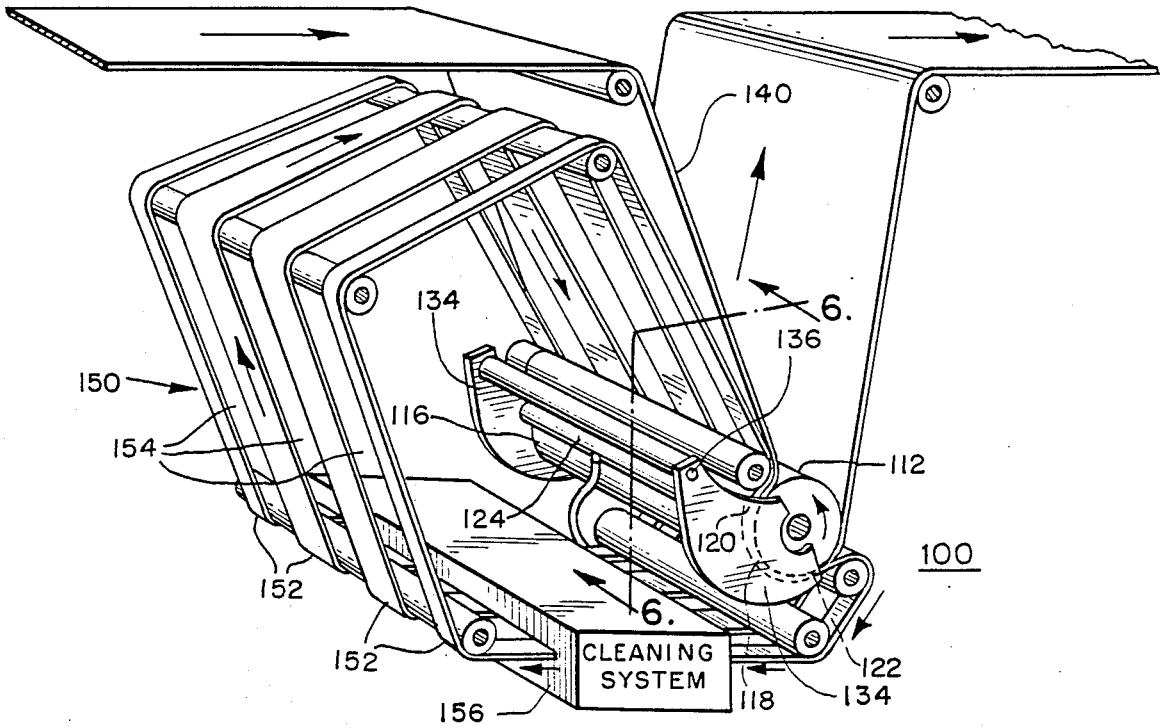

FIG. 4 is a perspective view of a saturator which incorporates a preferred embodiment of this invention.

Figure 5:
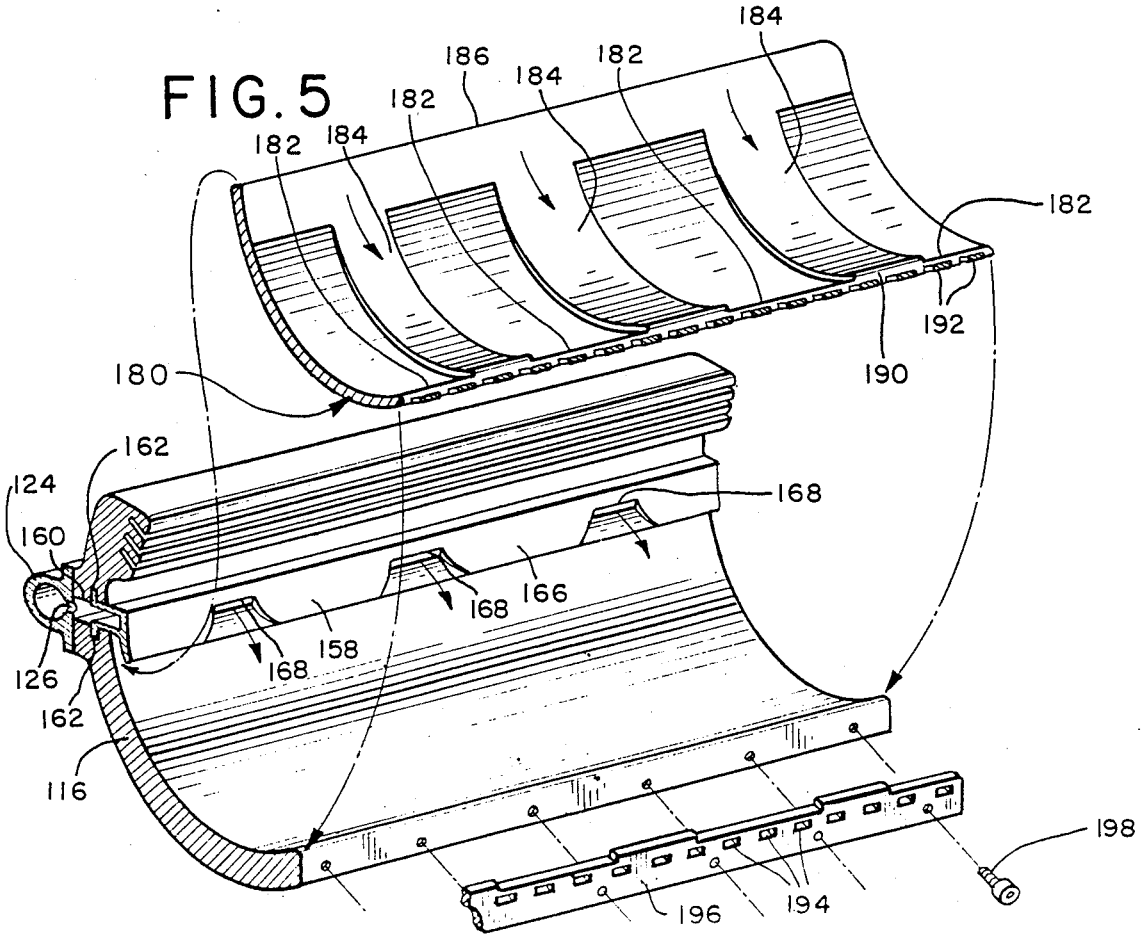

FIG. 5 is an exploded perspective view of components of the saturator of FIG. 4.

Figure 6:
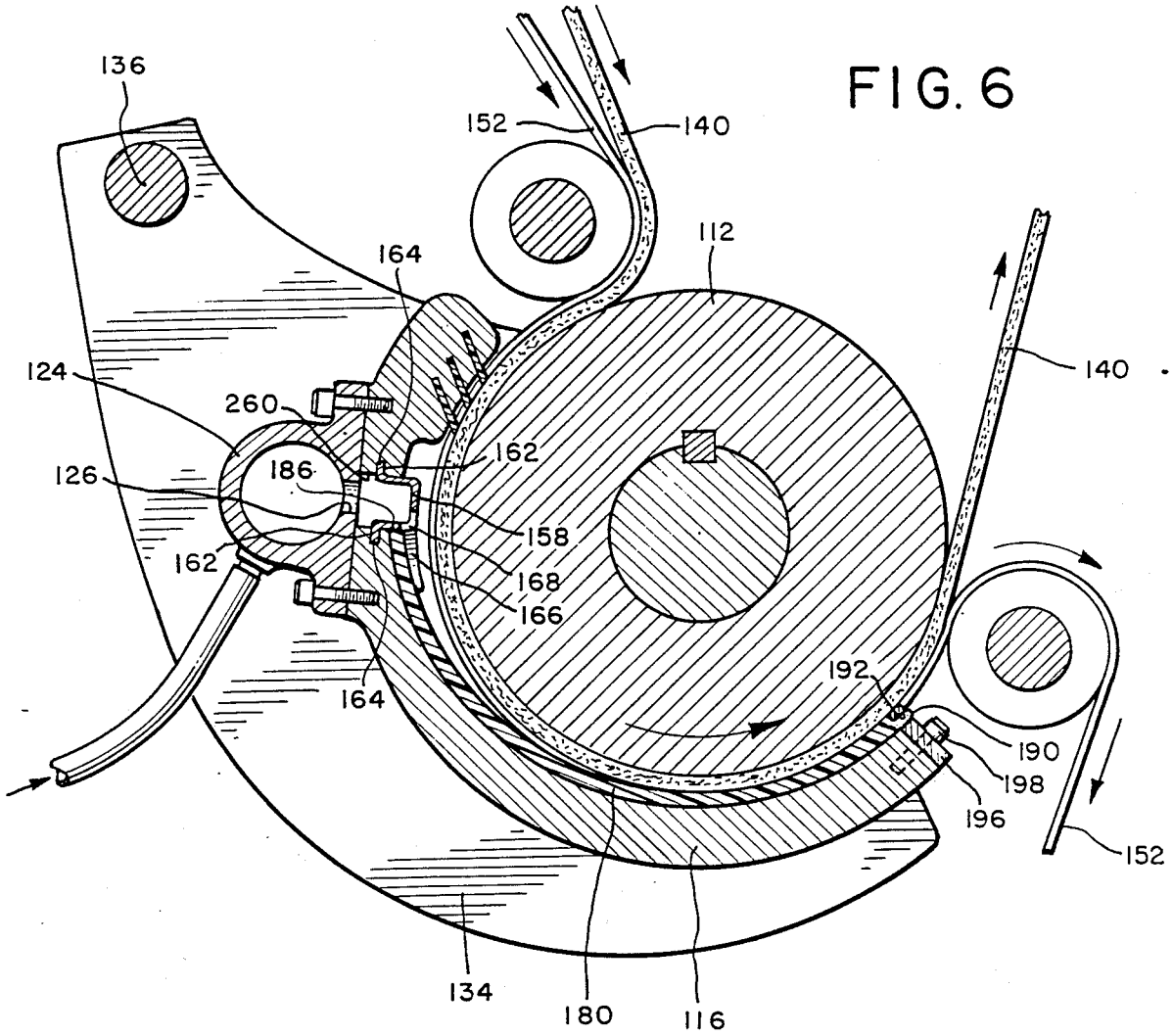

FIG. 6 is a sectional view taken along line 6—6 of FIG. 5.

Figure 7:
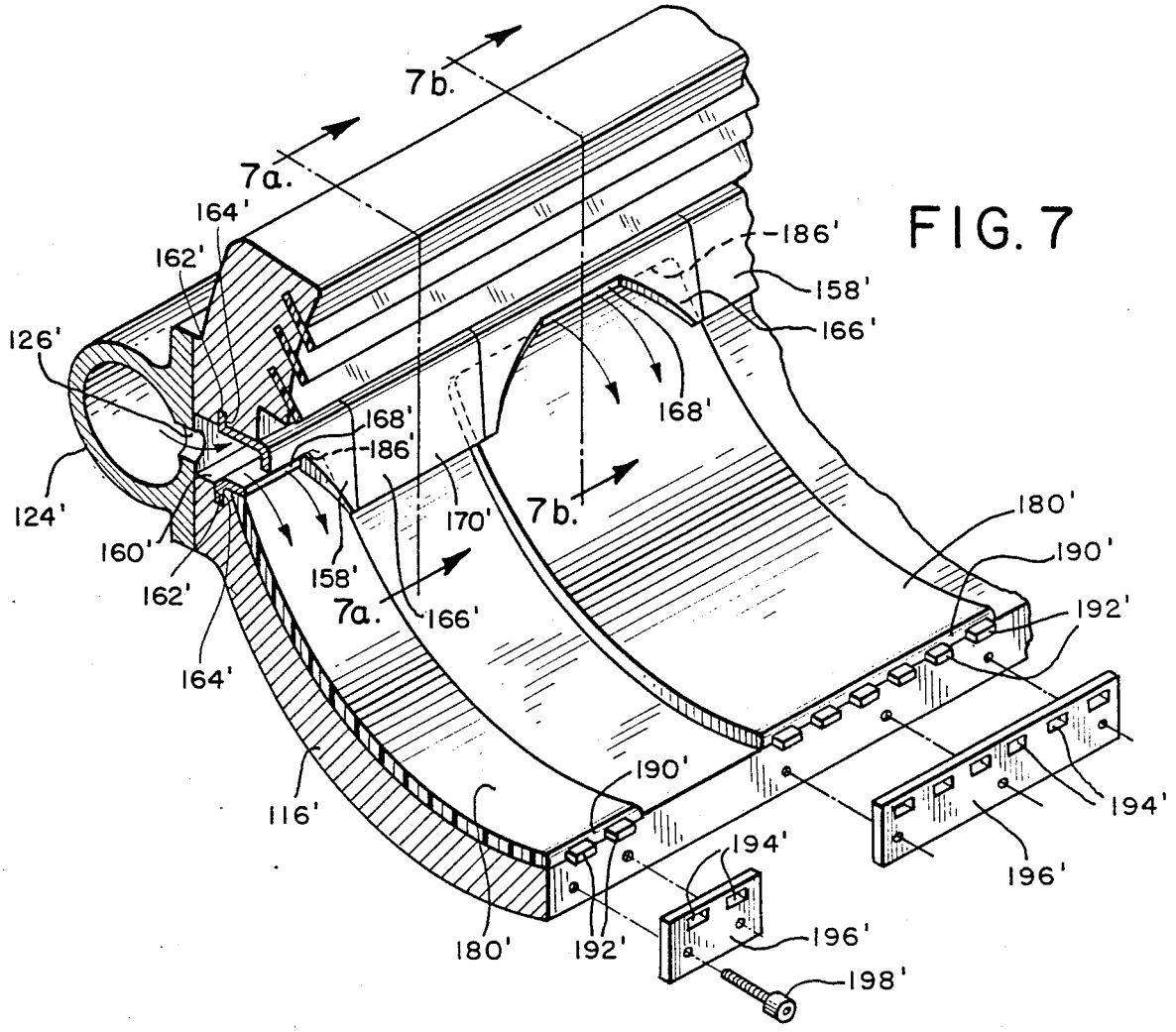
Figure 7A:
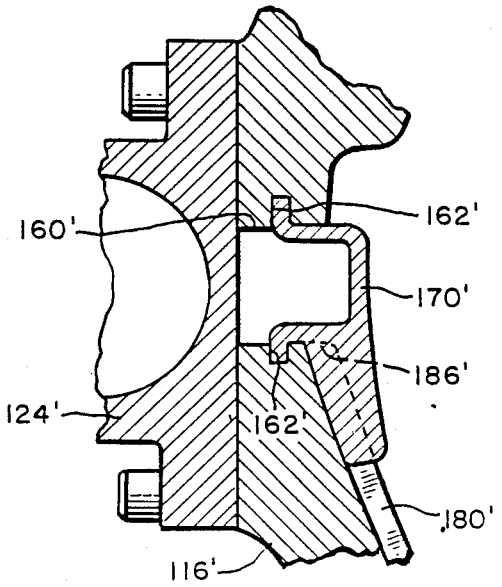
Figure 7B:
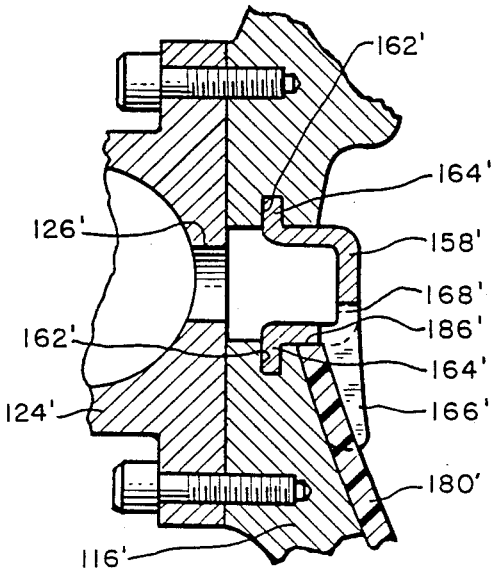

FIG. 7 is a fragmentary perspective view of portions of a variant of the embodiment of FIG. 4, which incorporates another preferred embodiment of this invention.

FIG. *7a* is a sectional view taken along line *7a—7a* of FIG. 7.

FIG. *7b* is a sectional view taken along line *7b—7b* of FIG. 7.

Figure 8:
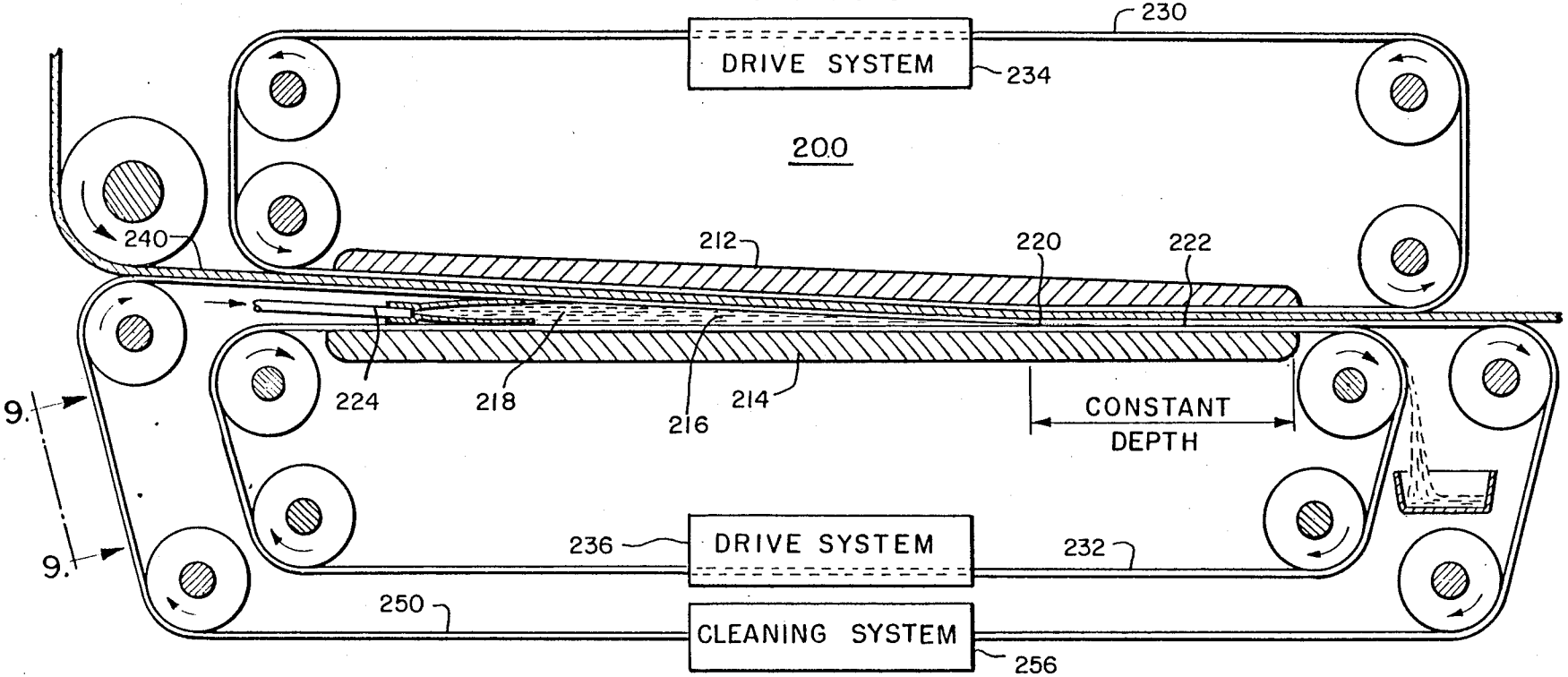

FIG. 8 is a cross-sectional view of a saturator which incorporates another preferred embodiment of this invention.

Figure 9:
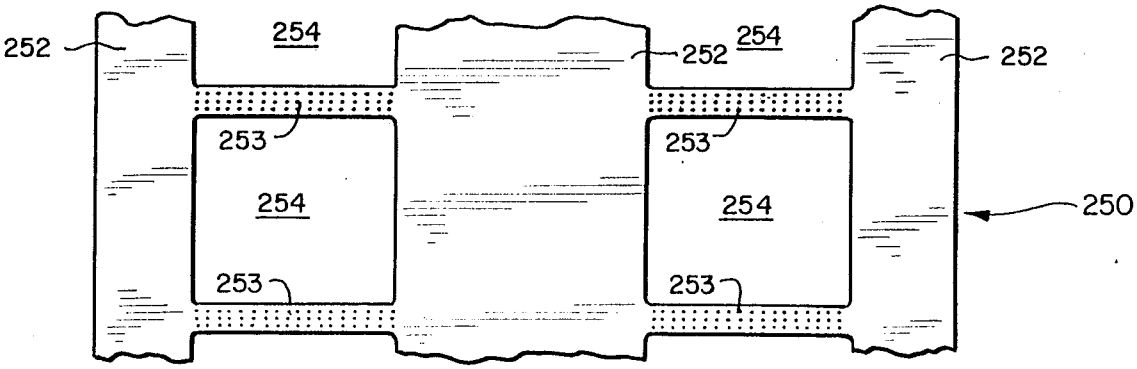

FIG. 9 is a fragmentary view taken along line 9—9 of FIG. 8.

DETAILED DESCRIPTION OF THE PREFERRED EMBODIMENTS

Turning now to the drawings, FIG. 1 shows a cross sectional view of a pattern-forming saturator 10. This saturator 10 includes a mandrel 12 which is mounted for powered rotation about an axis defined by a shaft 14. Typically, the mandrel 12 is formed of a steel shell having a length at least as great as the widest web to be processed. The mandrel 12 is mounted for rotation adjacent to a chamber defining element 16 which extends along the length of the mandrel 12. This chamber defining element 16 defines a chamber 18 between the element 16 and the mandrel 12. This chamber 18 is characterized by an entrance region 20 and an exit region 22. The chamber 18 is deeper in the entrance region 20 than in the exit region 22, and preferably the chamber 18 tapers in depth in a gradual and progressive manner.

A supply port 24 supplies a liquid saturant, such as an aqueous sodium silicate solution, to the chamber 18. If desired, the saturant can be supplied to the chamber 18 under pressure via the supply port 24, or alternately, the self-pressurizing features of the saturator 10 described below can be used to create the desired pressure of saturant within the chamber 18. A plurality of spring seals 26 formed of a suitable spring steel are mounted to the chamber defining element 16 adjacent to the entrance region 20 to impede the flow of saturant out of the chamber 18. An entrance roll 30 and an exit roll 32 are mounted for rotation adjacent to respective sides of the chamber defining element 16.

The features of the saturator 10 described above are substantially identical to those described in Menser U.S. Pat. No. 4,588,616. This patent is hereby incorporated by reference for its detailed teaching of the structure of the saturator 10, and in particular for its teaching of the geometry of the converging chamber 18. As explained in detail in the Menser patent, a web 40 is passed between the mandrel 12 and the chamber defining element 16, such that the web 40 is moved through the chamber 18 from the entrance region 20 to the exit region 22, carried by the rotation of the mandrel 12. Movement of the web 40 through the converging chamber 18 pressurizes the saturant within the chamber 18, thereby forcing the saturant to impregnate voids or pores in the web 40. After the web 40 has been impregnated with the saturant, it leaves the converging chamber 18 via the exit roll 32 and typically passes to an oven (not shown) where volatile components of the saturant are removed. As one example of a suitable saturant, aqueous solutions of sodium silicate as described in the Menser patent can be used.

As pointed out below, the arrangement of the supply port 24 can create localized variations in the amount of saturant impregnated into the web. Such variations can result from non-uniformity in the velocity of the saturant, which in turn result from the fact that the supply port 24 extends over only a small part of the width of the chamber.

A stencil 50 is provided to prevent patterned portions of the web 40 from coming into contact with the saturant in the chamber 18. This stencil 50 includes both impermeable regions 52 and permeable regions 54. As shown in FIG. 1, the stencil 50 preferably moves in a closed loop about the entrance roll 30, the exit roll 32, and idler rolls 56, such that the stencil 50 is in intimate contact with the side of the web 40 facing the chamber defining element 16. In the permeable regions 54 of the stencil 50, the saturant comes into contact with the web 40 and the web 40 is impregnated with saturant in the conventional manner. In the impermeable regions 52 of the stencil 50 the saturant is prevented from coming into contact with the web 40.

The stencil 50 preferably moves at the same linear speed as the web 40, such that there is no relative movement between the web 40 and the stencil 50. In this embodiment, this desired result is obtained in that the web 40 frictionally engages and drives the stencil 50. Of course, in alternate embodiments it may be preferable to provide an active drive system for the stencil 50 to synchronize the linear speed of the stencil 50 with the web 40.

FIGS. *2a*, *2b* and *2c* provide partial plan views of three exemplary stencils 50*a*, 50*b* and 50*c* that may be used with the pattern-forming saturator 10 of FIG. 1. The first example of FIG. *2a* includes two lateral bands 58, each having a substantially constant width, and each positioned to protect a respective lateral portion of the web 40. Thus, the impermeable regions 52*a* of the stencil 50*a* cover the two lateral edges of the web 40, and the permeable region 54*a* allows the central region of the web 40 to be impregnated with the saturant.

FIG. *2b* shows an alternative stencil 50*b* which includes one central band 60 having a generally uniform width. This central band 60 is positioned to insure that the impermeable region 52*b* is centered on the web 40 to prevent the central portion of the web 40 from being impregnated with the saturant. The lateral edges of the web 40 are aligned with the permeable regions 54*b* of the stencil 50*b*, and are impregnated with saturant as the web 40 moves through the chamber 18.

FIG. *2c* shows a third stencil 50*c* which comprises a band that extends over the full width of the web 40.

This band defines discreet permeable regions 54c, each completely surrounded by the band which forms the impermeable region 52c. The stencil 50c insures that the saturator 10 impregnates the web with the saturant only in isolated regions aligned with the discrete permeable regions 54c.

Figure 2A:
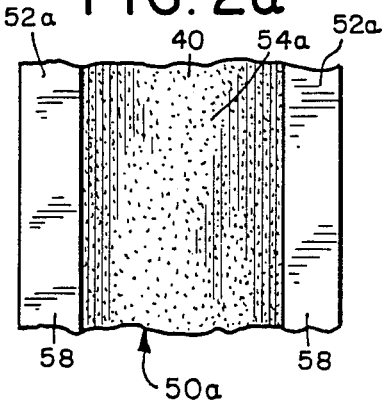
Figure 2B:
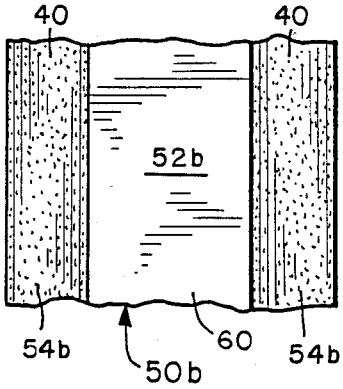
Figure 2C:
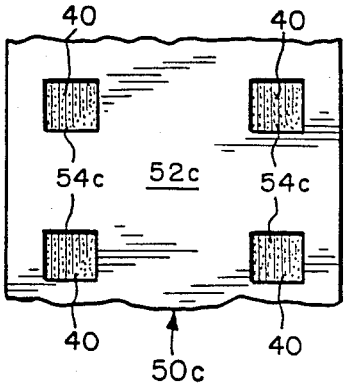

The saturator 10 provides high saturant pressures in the exit region 22. In order to reduce the leakage of saturant out the exit region 22, the saturator 10 includes an exit seal 70 which is best shown in FIG. 3. In FIG. 3 the stencil 50a of FIG. 2a is shown for illustrative purposes, including the two lateral bands 58. The exit seal 70 defines recesses 72 positioned to receive the lateral bands 58. These recesses 72 are separated by a raised area 74. The depth of each of the recesses 72 is substantially equal to the thickness of the lateral bands 58. The notched profile of the exit seal 70 defined by the recesses 72 and the raised area 74 seals the exit region 22 to minimize leakage of saturant past the exit seal 70.

In use, the web 40 is passed through the chamber 18 between the stencil 50 and the mandrel 12 such that regions of the web 40 aligned with the impermeable regions 52 of the stencil 50 are protected from contact with the saturant in the chamber 18, while regions of the web 40 aligned with the permeable regions 54 of the stencil 50 are impregnated with the saturant in the conventional manner. In this way, the saturant is applied only to the desired portions of the web 40, thereby providing important advantages in terms of both utility and economy. Utility is improved in that the saturant can be kept out of contact with undesired regions of the web, as for example regions of the web that are to be printed or otherwise processed in a manner incompatible with the saturant. Economy is improved in that by applying the saturant only to the desired portions of the web 40, the usage and therefore cost of the saturant needed to process a particular web 40 are reduced.

The saturator of FIGS. 4–6 is similar to the saturator 10 in that it includes a rotatable mandrel 112 and a stationary chamber defining element 116. A converging chamber 118 similar to the chamber 18 of the first preferred embodiment is defined between the element 116 and the mandrel 112. This converging chamber 118 defines a relatively deep entrance region 120 and a relatively shallow exit region 122, as described above. Saturant is supplied to the converging chamber 118 through a manifold 124. In alternate embodiments, the saturant can be supplied via the manifold 124 under a wide range of pressures, depending upon the desired degree of saturation and other parameters of the saturation process.

The chamber defining element 116 is mounted on a frame 134 which is, in turn, pivotably mounted for rotation about a pivot axis 136. This mounting arrangement for the element 116 provides a number of important advantages. First, the frame 134 can readily be pivoted away from the mandrel 112. This simplifies cleaning operations and it allows the element 116 to be moved briefly away from the mandrel 112 when necessary to pass a splice on the web 140. Furthermore, this arrangement allows the depth of the converging chamber 118 at the entrance and exit regions 120, 122 to be adjusted substantially independently of one another. By moving the pivot axis 136 toward and away from the mandrel 112, the depth of the entrance region 120 can be precisely adjusted without substantially altering the depth of the chamber 118 at the exit region 122. Similarly, by providing a precisely adjustable stop surface near the exit region 122, the frame 134 can be positioned so as to obtain the desired depth at the exit region 122 without significantly altering the depth at the entrance region 120.

The web 140 is moved through the converging chamber 118 by rotation of the mandrel 112. A stencil 150 is brought into contact with the surface of the web 140 adjacent to the saturant in the converging chamber 118, and friction between the stencil 150 and the web 140 insures that the stencil 150 moves at the same linear speed as the web 140, without slippage between the stencil 150 and the web 140. If desired, an auxiliary drive system can be provided for the stencil 150 to reduce drag on the web 140.

The stencil 150 includes a number of parallel bands spaced across the length of the mandrel 112. The bands themselves form impermeable regions 152 which prevent saturant from reaching the web 140. The regions between the bands act as permeable regions 154 which allow the saturant to reach and impregnate the web 140. FIG. 4 shows a stencil cleaning system 156 which removes saturant from the stencil 150. A variety of approaches can be used in the system 156 to clean the stencil, such as chemical baths, mechanical brushes, scrapers, and the like.

As best shown in FIGS. 5 and 6, an insert 180 is mounted to the element 116 such that it is the insert 180 that defines the interior wall of the converging chamber 118. This insert 180 is provided with a plurality of spaced parallel grooves 182, each sized to receive a respective one of the bands of the stencil 150. The grooves 182 are separated by raised areas 184. As shown in FIG. 5, the grooves 182 increase in depth as they approach the trailing edge 190 of the insert 180, and at the trailing edge 190 the grooves have a depth equal to the thickness of the bands such that the raised areas 184 directly contact the web 140.

The insert 180 can be formed of any suitable material and it is anticipated that a range of plastics and metals will be found suitable. In this embodiment, the converging chamber 118 is shaped much like the converging chamber 18 shown in FIG. 1, and the leading edge 186 of the insert 180 is positioned to abut a retainer 158 mounted to the element 116 near the entrance region 120.

The presently preferred arrangement for mounting the insert 180 in place is best shown in FIGS. 5 and 6. The element 116 defines a channel 160 which extends parallel to the mandrel 112. This channel 160 defines spaced parallel slots 162 which extend along the length the channel 160, and the channel 160 is connected to the manifold 124 through a plurality of spaced ports 126. The retainer 158 defines flanges 164 sized to fit within the slots 162 to hold the retainer 158 in place on the element 116. The retainer 158 defines a lip 166 which fits over the leading edge 186 of the insert 180 and holds it in place. A plurality of openings 168 are defined by the retainer 158 to allow saturant to flow from the channel 160 to the converging chamber 118 into the regions between the bands of the stencil 150. Thus, the retainer 158 both holds the leading edge 186 of the insert 180 in place and distributes saturant into the chamber 118.

As shown in FIG. 5, the openings 168 are substantially equal in width to the raised areas 184 which define the saturation zones. This aspect of the invention reduces non-uniformites in the amount of saturant added to the web across the width of each of the saturation zones. Such non-uniformities have been recognized as a problem in saturators in which saturant flows into the chamber through relatively small, widely spaced ports. This aspect of the invention can be used in saturators which do not employ stencils, in which case one of the openings 168 is preferably sized to extend completely across the entire width of the web. In this way uniform saturation across the entire width of the web can be obtained. Of course, in such embodiments which do not employ stencils, the insert 180 is preferably uniform across its width, and no grooves 182 are provided.

The trailing edge 180 of the insert 180 defines an array of protruding fingers 192 and these fingers 192 are captured in place by respective openings 194 in a plate 196. The plate 196 is in turn removably secured to the element 116, as for example by screws 198.

The insert 180 acts as a seal by receiving the bands of the stencil 150 within the grooves 182. In effect, the insert 180 becomes a portion of one wall of the converging chamber 118, and this wall is contoured to receive the stencil 150. In this way, the raised areas 184 can be positioned as close to the web 140 as desired to obtain the necessary sealing action and to develop the desired pressure within the converging chamber 118. Of course, in alternate embodiments, the grooves 182 can actually be formed in the element 116, thereby eliminating the need for a separate insert. However, the insert 180 provides important advantages, in that it allows the element 116 to be readily adapted to differing stencils, simply by replacing the insert 180. If necessary, the retainer 158 can readily be removed and replaced as well.

FIGS. 7, *7a* and *7b* relate to a preferred embodiment which is similar to the embodiment of FIGS. 4–6. The key difference is that in the embodiment of FIGS. *7–7b* the insert, retainer and plate are all formed of separate, modular components. In FIGS. *7–7b* the same reference numerals are used as in FIGS. 4–6 for corresponding elements, except that the reference numerals of FIGS. *7–7b* are primed. Except as indicated below, these embodiments are identical.

In the embodiment of FIGS. *7–7b*, the insert 180' is composed of multiple parallel, spaced elements, each of which defines a respective leading and trailing edge 186', 190'. The leading edges 186' are held in place by retainers 158', and the trailing edges 190' are held in place by plates 196', all as described above in connection with FIGS. 5–6. The bands of the stencil (not shown) are sized and positioned to move between the inserts 180'. Thus, the inserts 180' of FIG. 7 correspond in function to the raised areas 184 of FIG. 5 and the regions between the inserts 180' of FIG. 7 correspond to the grooves 182 of FIG. 5. The retainers 158' are separated by spacers 170' which slide in the slots 162' and block the flow of saturant out of the channel 160' in the region between the retainers 158'.

The embodiment of FIGS. *7–7b* is modular in construction, and it allows a small number of inserts 180', retainers 158', spacers 170' and plates 196' to be combined as desired to accommodate a large variety of spacings and widths of the bands of the stencil. Preferably the inserts 180' are equal in width to the corresponding retainers 158' and plates 196'.

FIGS. 8 and 9 relate to another preferred embodiment 200 of this invention. This embodiment 200 differs significantly from the previous embodiments in that neither of the two chamber defining elements 212,214 moves relative to the other in operation. Rather, each of the elements 212,214 is rigidly held in position by a frame (not shown). The two elements 212,214 define a converging chamber 216 therebetween. This converging chamber 216 includes a relatively deep entrance region 218 and a relatively shallow exit region 220. The elements 212,214 define an extended exit region 222 which provides an important sealing function as described below. Saturant is supplied to the converging chamber 216 via a supply port 224, which preferably extends completely across the width of the web 240 to provide uniform saturation in the saturation zones as described above.

The embodiment 200 includes upper and lower belts 230,232, each of which is rotated by a respective drive system 234,236 such that the two belts 232,234 move between the elements 212,214 at the same speed, thereby carrying the web 240 through the converging chamber 216. Preferably, these belts 230,232 are formed of an impermeable material such as stainless steel, and suitable lubricants are provided between the belts 230,232 and the chamber defining elements 212,214.

In addition, a closed loop stencil 250 is also passed through the converging chamber 216 positioned immediately adjacent to the web 240. This stencil 250 is moved at the same linear speed as the web 240, carried along by friction between the stencil 250 and the web 240. A stencil cleaning system 256 as described above is provided to remove saturant from the stencil 250.

As best shown in FIG. 9, in this embodiment the stencil 250 comprises a plurality of impermeable regions 252, each made up of a respective one of three parallel bands, and a plurality of permeable regions 254 positioned between the bands. In addition, the bands are interconnected by semi-permeable regions 253. In this embodiment, the semi-permeable regions 253 are formed of an impermeable sheet which defines a plurality of small openings. These openings allow some saturant to flow into the web 240. However, the flow of saturant into those portions of the web 240 aligned with the semi-permeable regions 253 is reduced as compared with the flow of saturant into those portions of the web 240 aligned with the permeable regions 254. Thus, the resulting saturated web 240 is devoid of saturant in certain portions aligned with the impermeable regions 252, is saturated to a greater extent in portions aligned with the permeable regions 254, and is saturated to a lesser extent in portions aligned with the semi-permeable regions 253. This can be of great advantage, for example, in conjunction with containers which are to have a high degree of saturation in the sidewalls, a low degree of saturation in the bend lines between adjacent sidewalls, and substantially no saturation in the end panels. The stencil 250 of FIG. 7 is suitable for such an application. The precise size and spacing of the openings of the semi-permeable regions 253 can be varied widely. However, in many cases it is preferable to have the openings sufficiently closely spaced such that the saturant is distributed across the entire portion of the web 240 aligned with the semi-permeable regions 253, rather than being localized into individual spots.

The extended exit 222 shown in FIG. 6 defines a chamber depth which is substantially equal to the sum of the thicknesses of the belts 230,232, the web 240, and the stencil 250. The length of the extended exit 222 along the direction of motion of the web 240 is preferably greater than the separation between two adjacent semi-permeable regions 253 along the direction of motion of the stencil 250. In this way, the pressure drop across a single one of the semi-permeable regions 253 is reduced, and the tendency to stretch the stencil 250 is reduced as well.

Of course, it should be understood that a wide range of changes and modifications can be made to the preferred embodiments described above. For example, it is not necessary in all embodiments that a converging chamber be used. Rather, a non-converging chamber of the type shown in Penley U.S. Pat. No. 2,711,032 is well suited for some applications. Furthermore, the particular geometry of the stencil can readily be adapted for the particular application. In the preferred embodiment described above, the stencil is formed of a sheet of stainless steel. However, other materials can be used as appropriate for the particular application.

It is therefore intended that the foregoing detailed description be regarded as illustrative rather than limiting, and that it be understood that it is the following claims, including all equivalents, which are intended to define the scope of this invention.

I claim:

1. In a saturator of the type comprising means for defining a saturation zone for containing a pressurized saturant therein and means for moving a web through the saturation zone along a translation axis to bring a first side of the web into contact with the pressurized saturant to cause the saturant to impregnate the web, the improvement comprising:

means for introducing saturant into the saturation zone substantially uniformly across substantially the full width of the saturation zone transverse to the translation axis, wherein the saturation zone extends only partially across the web.

2. The invention of claim 1 wherein the saturation zone converges in depth along the translation axis such that movement of the web through the saturation zone pressurizes the saturant.

3. The invention of claim 1 wherein the means for defining the saturation zone comprises a rotatable mandrel and an opposed element.

4. A method for impregnating a web with a saturant in a saturator of the type comprising means for defining a saturation zone for containing a pressurized saturant therein and means for moving the web through the saturation zone along a translation axis to bring a first side of the web into contact with the pressurized saturant to cause the saturant to impregnate the web in the saturation zone, said method comprising the following steps:

providing a saturant port which extends across substantially the full width of the saturation zone transverse to the translation axis, wherein the saturation zone extends only partially across the web; and introducing saturant into the saturation zone through the saturant port while moving the web through the chamber.

5. The method of claim 4 wherein the saturation zone converges in depth along the translation axis such that movement of the web through the saturation zone pressurizes the saturant.

6. The method of claim 4 wherein the means for defining the saturation zone comprises a rotatable mandrel and an opposed element.

* * * * *